US009646456B2

(12) United States Patent
Bramble

(10) Patent No.: US 9,646,456 B2
(45) Date of Patent: May 9, 2017

(54) GAMING SYSTEM, A METHOD OF GAMING AND A JACKPOT CONTROLLER

(71) Applicant: Aristocrat Technologies Australia Pty Limited, North Ryde NSW (AU)

(72) Inventor: Paul Francis Jason Bramble, St. Leonards (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 795 days.

(21) Appl. No.: 13/705,757

(22) Filed: Dec. 5, 2012

(65) Prior Publication Data

US 2013/0172076 A1 Jul. 4, 2013

(30) Foreign Application Priority Data

Dec. 5, 2011 (AU) ..... 2011905056

(51) Int. Cl.
*G07F 17/32* (2006.01)
*G07F 17/34* (2006.01)

(52) U.S. Cl.
CPC ..... *G07F 17/3232* (2013.01); *G07F 17/3244* (2013.01); *G07F 17/3258* (2013.01); *G07F 17/34* (2013.01)

(58) Field of Classification Search
CPC ... G07F 17/3232; G07F 17/3258; G07F 17/34
USPC ..... 463/27
See application file for complete search history.

(56) References Cited

U.S. PATENT DOCUMENTS

| | | | | |
|---|---|---|---|---|
| 4,837,728 | A * | 6/1989 | Barrie et al. | 463/27 |
| 5,042,810 | A * | 8/1991 | Williams | 463/17 |
| 5,280,909 | A * | 1/1994 | Tracy | 463/27 |
| 5,885,158 | A * | 3/1999 | Torango et al. | 463/27 |
| 6,039,648 | A | 3/2000 | Guinn et al. | |
| 6,146,273 | A | 11/2000 | Olsen | |
| 6,210,275 | B1 | 4/2001 | Olsen | |
| 6,966,834 | B1 * | 11/2005 | Johnson | 463/25 |
| 7,651,394 | B2 * | 1/2010 | Johnson | 463/26 |
| 7,931,532 | B2 * | 4/2011 | Johnson | 463/27 |
| 8,147,324 | B2 * | 4/2012 | Mothwurf | A63F 3/00157 463/25 |
| 8,303,401 | B2 * | 11/2012 | Yoshimura | 463/27 |
| 8,317,605 | B2 * | 11/2012 | Bramble | 463/27 |

(Continued)

FOREIGN PATENT DOCUMENTS

| | | | |
|---|---|---|---|
| AU | 1096999 | A | 5/1999 |
| AU | 736679 | B2 | 8/2001 |

(Continued)

*Primary Examiner* — William H McCulloch, Jr.
(74) *Attorney, Agent, or Firm* — Armstrong Teasdale LLP

(57) ABSTRACT

A method for providing a jackpot controlled by a computer implemented jackpot controller. The method includes (a) on commencement of the jackpot, the jackpot controller setting a start-up jackpot prize value, the start-up prize value being the sum of a base amount and a predefined average increment amount for the jackpot, (b) incrementing the jackpot prize value by the jackpot controller using contributions from at least one participating gaming device until a jackpot trigger is determined; and (c) in response to the jackpot controller determining the jackpot trigger, awarding the jackpot prize and re-setting the jackpot prize value to the base amount.

16 Claims, 8 Drawing Sheets

(56) References Cited

U.S. PATENT DOCUMENTS

| | | | | |
|---|---|---|---|---|
| 8,360,868 | B2 | 1/2013 | Shvili | |
| 8,506,392 | B2 * | 8/2013 | Jaffe | 463/27 |
| 8,512,132 | B2 * | 8/2013 | Nicely | 463/27 |
| 8,556,703 | B2 * | 10/2013 | Bramble | 463/21 |
| 8,608,555 | B2 * | 12/2013 | Bramble | 463/26 |
| 8,628,410 | B2 * | 1/2014 | Jaffe et al. | 463/25 |
| 8,740,692 | B2 * | 6/2014 | Yoseloff et al. | 463/25 |
| 9,449,463 | B2 * | 9/2016 | Walker | G07F 17/3258 |
| 2004/0053655 | A1 | 3/2004 | Hyams et al. | |
| 2004/0166942 | A1 | 8/2004 | Muir | |
| 2005/0079911 | A1 * | 4/2005 | Nakatsu | 463/26 |
| 2005/0124404 | A1 | 6/2005 | Nicely | |
| 2005/0239542 | A1 * | 10/2005 | Olsen | 463/27 |
| 2007/0060365 | A1 | 3/2007 | Tien et al. | |
| 2008/0090651 | A1 * | 4/2008 | Baerlocher | 463/27 |
| 2008/0287185 | A1 * | 11/2008 | Yoseloff et al. | 463/27 |
| 2009/0075712 | A1 | 3/2009 | Englman et al. | |
| 2011/0201403 | A1 * | 8/2011 | Jaffe et al. | 463/20 |
| 2011/0201416 | A1 * | 8/2011 | Jaffe | 463/27 |
| 2011/0275433 | A1 * | 11/2011 | Bramble | 463/27 |
| 2012/0094743 | A1 * | 4/2012 | Odom et al. | 463/20 |
| 2013/0084966 | A1 * | 4/2013 | Nicely | 463/27 |
| 2013/0172076 | A1 * | 7/2013 | Bramble | 463/27 |
| 2016/0196720 | A1 * | 7/2016 | Bramble | G07F 17/32 463/25 |

FOREIGN PATENT DOCUMENTS

| | | | |
|---|---|---|---|
| CA | 2504494 | A1 | 10/2006 |
| JP | 2006212285 | A | 8/2006 |
| JP | 2006341029 | A | 12/2006 |
| JP | 2007006945 | A | 1/2007 |
| JP | 2007006946 | A | 1/2007 |
| JP | 2007006980 | A | 1/2007 |
| JP | 2007006981 | A | 1/2007 |
| JP | 2007054190 | A | 3/2007 |
| JP | 2007097657 | A | 4/2007 |
| JP | 2007260437 | A | 10/2007 |
| JP | 2007312981 | A | 12/2007 |
| JP | 2008061752 | A | 3/2008 |
| JP | 2008200534 | A | 9/2008 |
| JP | 2008200535 | A | 9/2008 |
| WO | 9921630 | A1 | 5/1999 |
| WO | 2005046815 | A2 | 5/2005 |
| WO | 2005046815 | A3 | 5/2005 |
| WO | 2008109949 | A1 | 9/2008 |

* cited by examiner

GAMING SYSTEM, A METHOD OF GAMING AND A JACKPOT CONTROLLER

RELATED APPLICATIONS

This application claims priority to Australian Application No. 2011905056 having an International filing date of Dec. 5, 2011, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepping machine provided with reels with each reel carrying several symbols of the set, or a video machine wherein selected symbols are displayed on virtual reels on a graphical display device. Win outcomes can occur based on symbols appearing in one or more horizontal lines, diagonal lines, or any other predetermined way.

It is also known to award high paying prizes, referred to as jackpot prizes, which may be funded from a prize pool. Typically, a portion of a gaming machine's turnover is forwarded to a jackpot controller which maintains the prize pool.

BRIEF SUMMARY OF THE INVENTION

In accordance with a first aspect, the present invention provides a method for providing a jackpot controlled by a computer implemented jackpot controller, the method comprising the steps of:

(a) on commencement of the jackpot, the jackpot controller setting a start-up jackpot prize value, the start-up prize value being the sum of a base amount and a predefined average increment amount for the jackpot;

(b) incrementing the jackpot prize value by the jackpot controller using contributions from at least one participating gaming device until a jackpot trigger is determined; and (c) in response to the jackpot controller determining the jackpot trigger, awarding the jackpot prize and re-setting the jackpot prize value to the base amount.

In an embodiment the method further comprises repeating steps (b) and (c) for awarding subsequent jackpots.

In an embodiment the average increment amount is a predefined percentage of the base amount.

In an embodiment the jackpot is a progressive jackpot such that each participating gaming device contributes to the jackpot prize at a predefined contribution rate.

In an embodiment the base value is a fixed non-zero amount.

In an embodiment the method further comprises the jackpot controller incrementing a hidden meter using a portion of the contributions in order to fund the base amount, once the jackpot has been re-set.

In accordance with a second aspect of the present invention there is provided a jackpot controller arranged to maintain a jackpot, the jackpot controller comprising:

a configuration module arranged to set a start-up jackpot prize value on commencement of the jackpot, the start-up prize value being the sum of a base amount and a predefined average increment amount for the jackpot;

an increment processor arranged to increment the jackpot prize value using contributions from at least one participating gaming device until a jackpot trigger is determined; and an award handler arranged to award the jackpot prize in response to determining the trigger and instruct the jackpot prize value to be reset to the base amount.

In an embodiment the average increment amount is a predefined percentage of the base amount.

In an embodiment the jackpot is a progressive jackpot such that each participating gaming device contributes to the jackpot prize at a predefined contribution rate.

In an embodiment the base value is a fixed non-zero amount.

In an embodiment the increment processor is further arranged to increment a hidden meter using a portion of the contributions in order to fund the base amount, once the jackpot has been re-set.

In an embodiment the trigger is a symbol driven trigger occurring on the participating gaming machines.

In an embodiment the trigger is a randomly determined mystery trigger which falls within a range which spans between the base amount and a predefined maximum trigger value.

In accordance with a third aspect the present invention provides a gaming system comprising a jackpot controller in accordance with the first aspect; and at least one gaming device operable to contribute to the jackpot prize.

In accordance with a fourth aspect the present invention provides a computer program comprising instructions for controlling a jackpot controller in accordance with the second aspect.

In accordance with a fifth aspect the present invention provides a tangible computer readable medium providing a computer program in accordance with the fourth aspect.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

An embodiment of the invention comprises a method for providing a jackpot. The method comprises, on commencement of the jackpot, setting a start-up jackpot prize value, the start-up prize value being the sum of a base amount and a predefined average increment amount for the jackpot. The jackpot prize value is subsequently incremented using contributions from at least one participating gaming device until a jackpot trigger is determined. In response to determining the jackpot trigger, the jackpot prize is awarded and the jackpot prize value reset to the base amount.

It will be understood by persons skilled in the art that the invention may be implemented in a number of forms, for example in a stand alone form on the at least one gaming device (e.g. such as an electronic gaming machine), or in a jackpot controller connected to the at least one gaming device such that any one of the gaming devices can win the progressive jackpot prize(s).

Overview of Exemplary Gaming System with a Jackpot Controller

Figure 1:
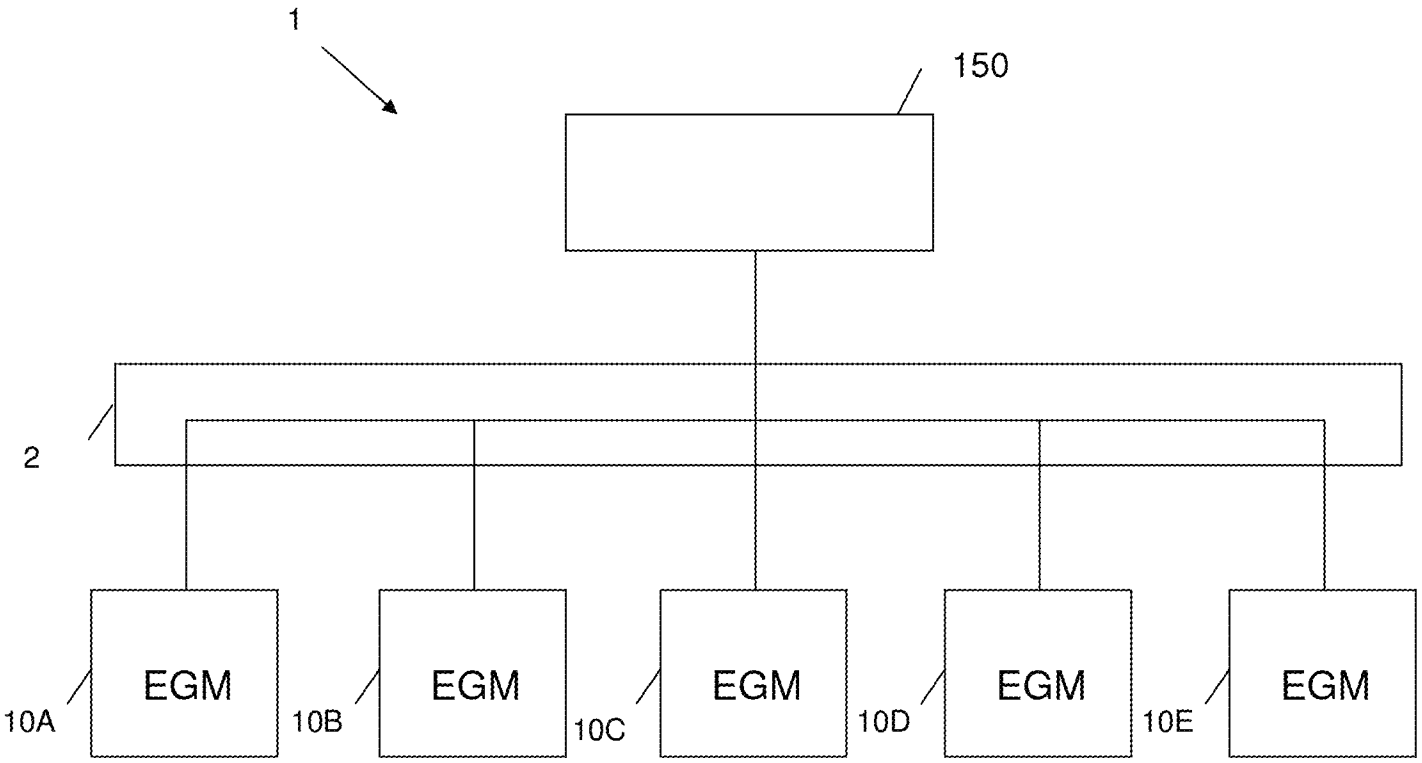
FIG. 1 is a block diagram of a gaming system with a jackpot controller.

FIG. 1 shows an exemplary gaming system 1 where a jackpot controller 150 is in data communication over a network 2, such as an Ethernet, with a bank of five gaming devices in the form of standalone gaming machines 10. The jackpot controller 150 is arranged to communicate with the gaming devices to determine how many devices are participating. The jackpot controller 150 implements a game where participating ones of the plurality of gaming devices 10 are entitled to share in any awards from the game and the manner in which the game is evaluated depends on the number of participating gaming devices 10.

Gaming Devices

Gaming devices capable of participating in the method of gaming of the embodiment can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
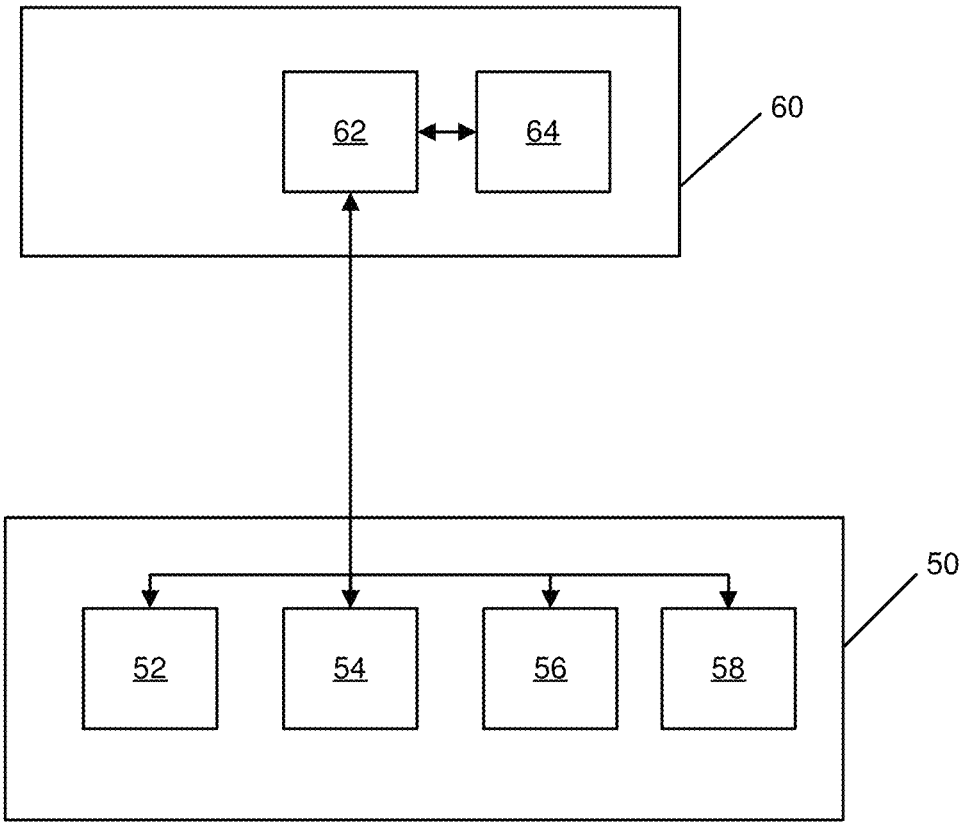
FIG. 2 is a block diagram of the core components of a gaming system.

Irrespective of the form, the gaming system has several core components. At the broadest level, the core components are a player interface 50 and a game controller 60 as illustrated in FIG. 2. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 3:
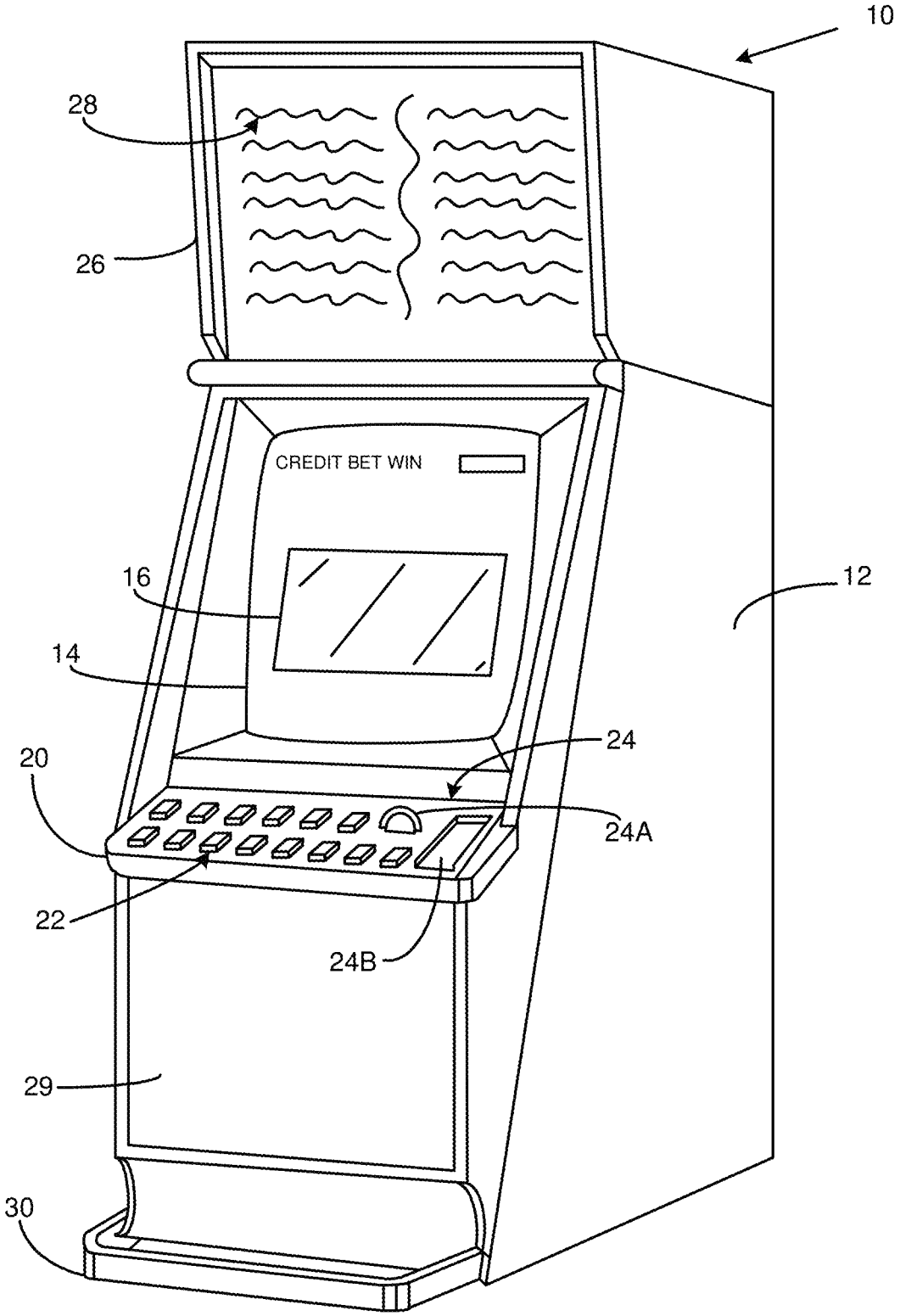
FIG. 3 is a perspective view of a stand alone gaming machine.

A gaming device in the form of a stand alone gaming machine 10 is illustrated in FIG. 3. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may be configured for ticket in that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 3 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 4:
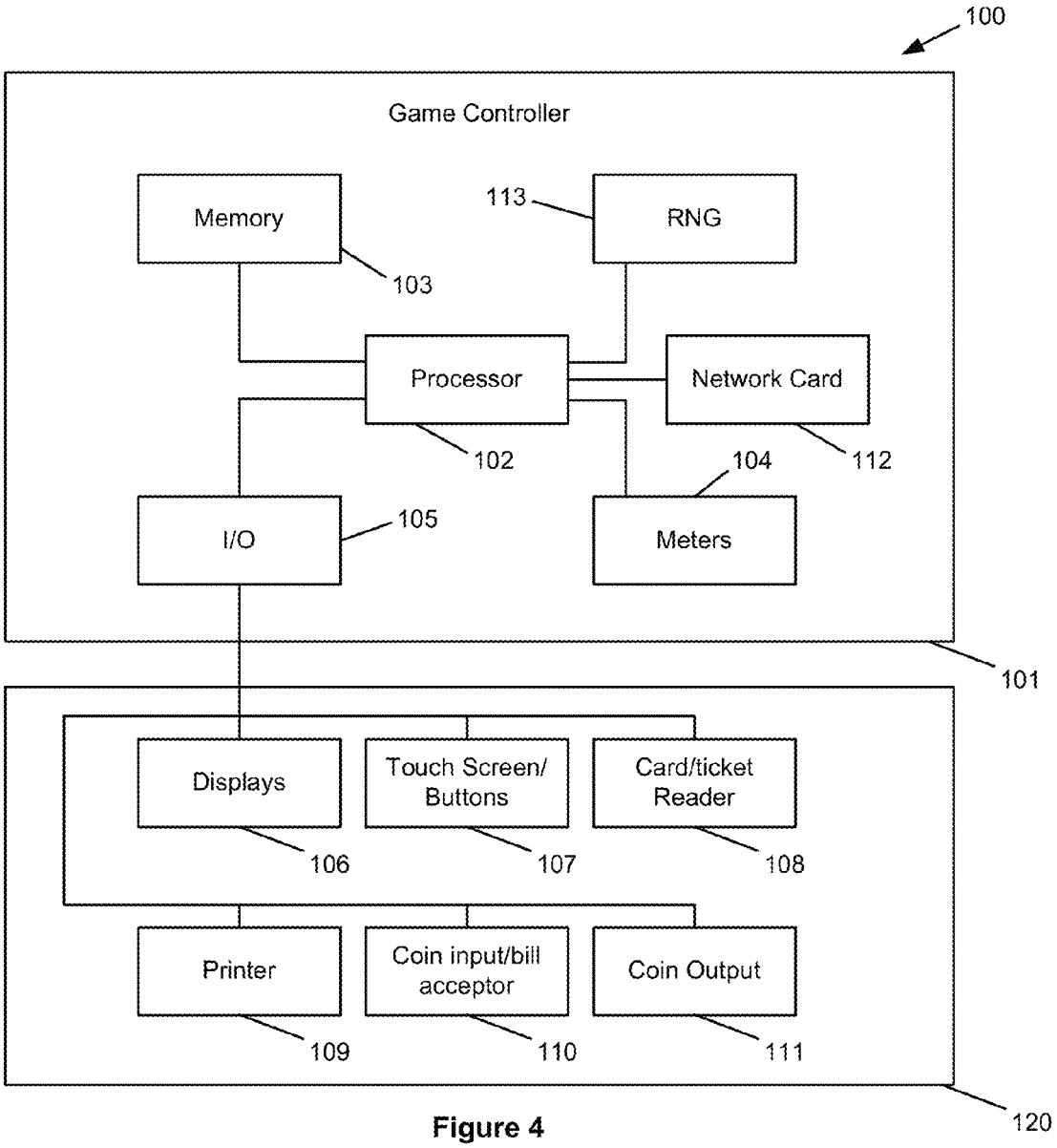
FIG. 4 is a block diagram of the functional components of a gaming machine.

FIG. 4 shows a block diagram of operative components of a typical gaming machine which may be the same as or different to the gaming machine of FIG. 3.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 4, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 5:
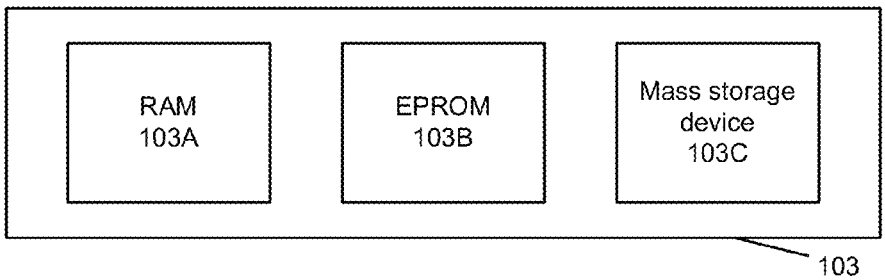
FIG. 5 is a schematic diagram of the functional components of a memory.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 6:
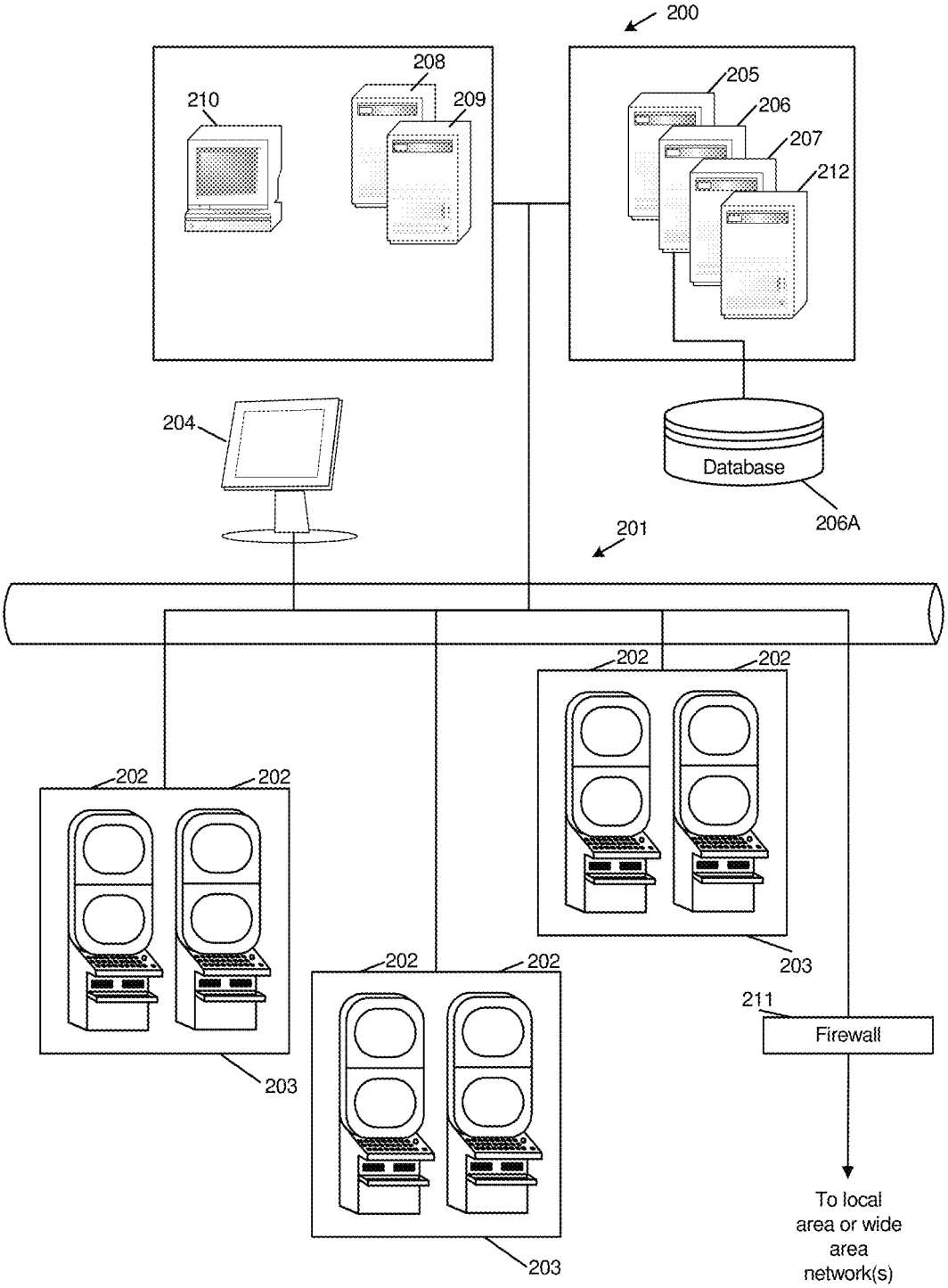
FIG. 6 is a schematic diagram of a network gaming system.

FIG. 6 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 6, are connected to the network 201. The gaming machines 202 provide a player operable interface and may be the same as the gaming machines 10,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server gaming architecture can be found in WO 2006/052213 and PCT/SE2006/000559, the disclosures of which are incorporated herein by reference. In such an embodiment, a jackpot controller can be provided, for example, by a dedicated server in data communication with the game server.

In an embodiment, a jackpot controller can be provided for a bank of machines as illustrated in FIG. 1.

The jackpot controller can be provided within such a network 200 by jackpot server 207, such that the jackpot game server may implement a jackpot game for a plurality of different banks of gaming machines rather than a specific jackpot controller being provided for each bank of gaming machines. Alternatively, there may be a single jackpot for the network managed by the jackpot server.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided.

Further Detail of Jackpot Controller

Figure 7:
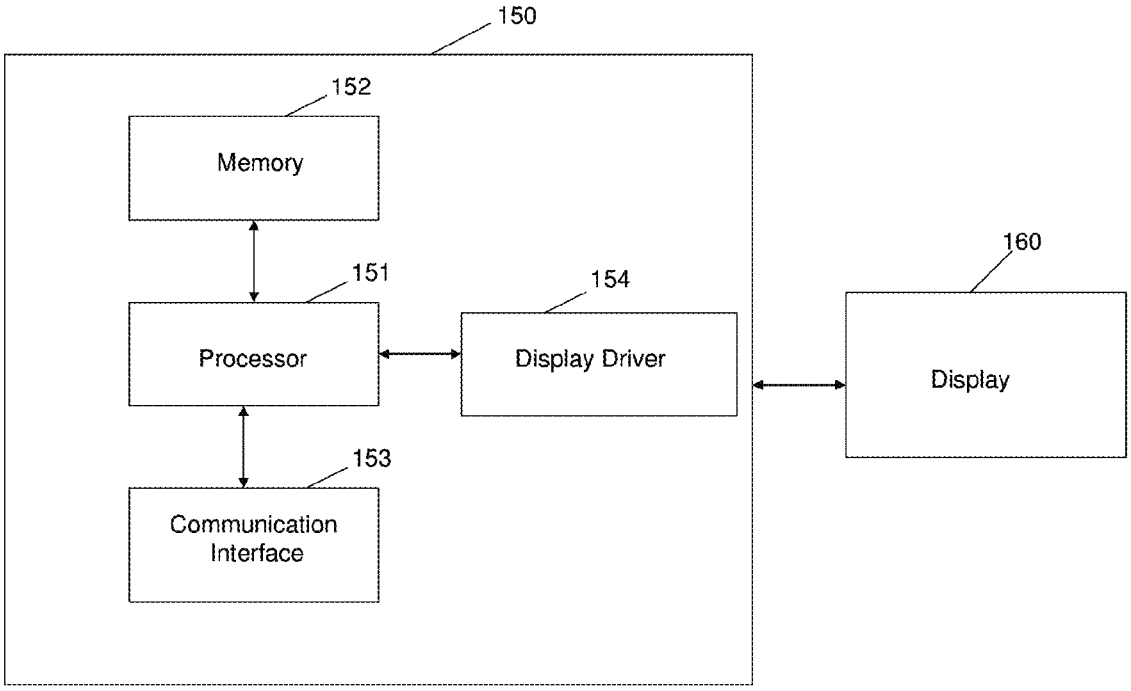
FIG. 7 is a block diagram of an embodiment of a jackpot controller connected to a central display.

Referring to FIG. 7 there is shown further detail of the jackpot controller 150, according to an embodiment of the present invention. From FIG. 7 it will be apparent that jackpot controller 150 is in data communication with a communal display 160 on which a current value of the jackpot prize or prizes can be displayed to the players playing the bank of gaming machines 10 shown in FIG. 1. In other embodiments, the gaming outcomes could be displayed on a top box of the individual gaming machines 10, rather than being displayed on a communal display, or in addition to such a display.

The jackpot controller 150 implements the jackpot in accordance with program code stored in memory 152 and includes a display driver 154 for driving the display 160, to show jackpot information. It will be noted that the jackpot controller 150 also includes a communication interface 153 which is designed to enable the processor 151 to communicate with each of the gaming devices 10 to receive jackpot increments and in relation to any prize award.

Persons skilled in the art will appreciate the above components are the core components for implementing a jackpot but other components may be present in a jackpot controller.

Jackpot prizes can be funded from a prize pool which is contributed to from the credit wagered to play gaming devices 10 participating in the jackpot and so as to be eligible for the award of a jackpot prize. The jackpot may be for a single game device 10 or a plurality of linked gaming devices. Contributions to the jackpot pool are typically a portion of the amount wagered to play the games of the gaming devices 10. Thus as the gaming devices 10 are played the value of the jackpot pool is correspondingly incremented based on the credit wagered. The jackpot prize pool will often start at a non-zero value, which can assist in attracting players to the gaming device(s) and once a jackpot is awarded the prize pool can be reset to the non-zero reset value.

The jackpot controller 150 is configured to communicate with the gaming devices 10 to receive jackpot increments. For example the jackpot controller can receive data indicating the amount of credit wagered for each game play and increment a prize pool with an amount proportional to the wagered amount, for example a percentage of the wagered amount. Alternatively the jackpot controller may receive data indicating each time a game is played on the gaming device and update a prize pool with a fixed credit amount for each play where the credit wager for the game is fixed. It should be appreciated that any alternative is contemplated within the scope of the present invention.

The jackpot controller 150 is configured to award a jackpot prize on average once for every predetermined amount of credit has been wagered.

One common type of jackpot is the progressive jackpot whereby a jackpot prize is awarded when a randomly determined jackpot prize pool trigger value is reached. Progressive jackpots are designed to be awarded, on average, once for every predefined amount of credits wagered by the gaming machines which contribute to the prize pool at some predefined contribution rate. For example, the progressive jackpot may be configured to be awarded once for every $10,000 of accumulated turnover, with a 1% contribution rate set for each gaming machine. Thus on average $100 will be contributed to the jackpot prize pool between each award of the jackpot prize, this is also known as the average increment amount. The prize pool may have a reset value of $1000 or 10% of the accumulated turnover for each award. According to such a configuration the average jackpot rate of return to the player would be $1,100 or 11% of the accumulated turnover. It should appreciate that the accumulated turnover, contribution rates and reset values will vary between embodiments.

Embodiments of the present invention take account of the realisation that, according to conventional awarding techniques, the jackpot prize may offer less than the average jackpot return when first installed due to the start-up value for the jackpot being identical to the reset value (i.e. the value at which the jackpot is re-set to after each subsequent awarding of the jackpot prize), thereafter it accumulates and oscillates about a higher increment. On initialisation of the jackpot the jackpot prize pool so the amount available to a player is set to the start-up value which is less than the designed average return to player. Supposing the jackpot is disabled at some later stage, there may be a discrepancy between the amount accumulated and the average return (i.e. due to the jackpot being started at a lower value than the average award), which is unfair to players participating in the jackpot.

The jackpot controller 150 according to embodiments described herein is configured such that it is started with a value which is the sum of a base amount plus the average increment amount (i.e. the average amount by which the jackpot prize value increments before being awarded). Thereafter, the jackpot prize value is re-set to the base amount after each trigger. Thus, irrespective of when the jackpot is disabled, a jackpot configured in accordance with the present invention will provide a return which may not fall below the average jackpot return, thus providing a jackpot which is fairer to players.

Figure 8:
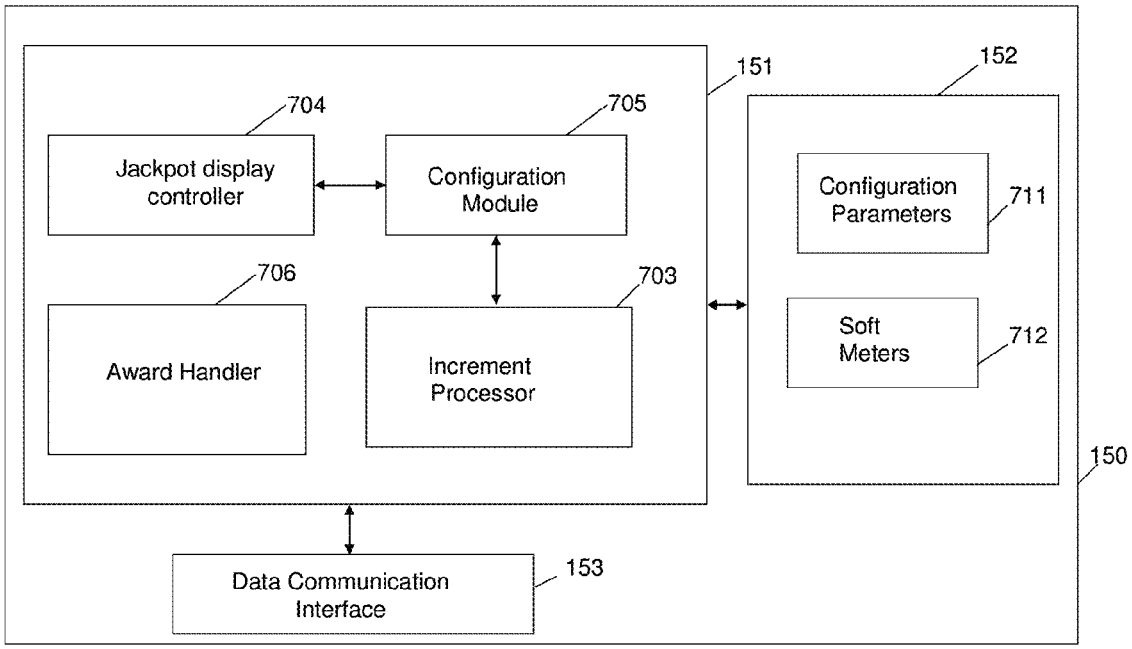
FIG. 8 is a block diagram of an embodiment of a jackpot controller.

With reference to FIG. 8 there is shown a functional block diagram of the jackpot controller 150 arranged to implement the above functionality. The jackpot controller 150 comprises a processor 151 which implements a number of modules, namely an increment processor 703, jackpot display controller 704, configuration module 705 and award handler 706, based on program code stored in memory 152.

In more detail, the configuration module 705 is arranged to configure the jackpot based on configuration parameters 711 stored in memory 162. According to embodiments described herein, the configuration parameters specify a start-up value which is to be applied upon commencement of the jackpot. As previously mentioned, the start-up value applied herein is defined as the sum of some non-zero base amount and an average increment amount for the jackpot prize. The average increment amount is the average amount by which the jackpot prize value will increment before being awarded and may typically be some predefined percentage of the base amount. A reset value (to which the jackpot is reset after awarding each jackpot) is also stored in memory and according to embodiment described herein is set to correspond with the base amount.

The increment processor 703 is arranged to receive jackpot contributions (hereafter "increments") for incrementing a soft meter 712 which keeps an absolute value of the jackpot prize stored in memory 152. The increments are received at some predefined contribution rate from the gaming devices 10. The jackpot display controller 704 determines from the absolute values what actual value of the prize is to be displayed on display 160. In an embodiment, the increment processor 703 may also implement a hidden meter (hidden in the sense that the amount of the meter may not be displayed to players), such that a portion of the increments are added to the hidden meter and used to fund the reset value for future jackpots. Again a soft meter 712 may be configured for handling the hidden increments.

FIG. 8 shows that the jackpot controller includes an award handler 706 which awards the jackpot prize in response to a jackpot trigger being determined. In an embodiment, the jackpot may be a mystery progressive jackpot such that a jackpot prize trigger value is randomly set between a minimum amount (which may be the base value) and some maximum amount. The randomly determined prize trigger value may be stored as a configuration parameter 711 and evaluated by the increment processor 703; such that once it is reached a signal is sent to the award handler 706 which triggers the awarding of the prize. The awards handler 706 then communicates the amount won to the relevant gaming device by a data communication interface 153 and starts a new soft meter for the jackpot (i.e. having a reset value corresponding to the base amount).

In an alternative embodiment the prize trigger is a symbol driven trigger occurring on the participating gaming devices. In this embodiment the jackpot controller can include a trigger monitor configured to identify when the symbol trigger occurs on one of the participating gaming devices and send a signal to the award handler 706 to trigger awarding of the prize. For example, the trigger monitor may receive game outcome data from each gaming device and identify the symbol trigger occurring from the game outcome data. Alternatively the trigger monitor may receive an indication of a symbol trigger occurring in a game outcome of a gaming device, for example a special trigger symbol or combination of symbols occurring in a game outcome causes the gaming device to send a trigger signal to the trigger monitor.

Figure 9:
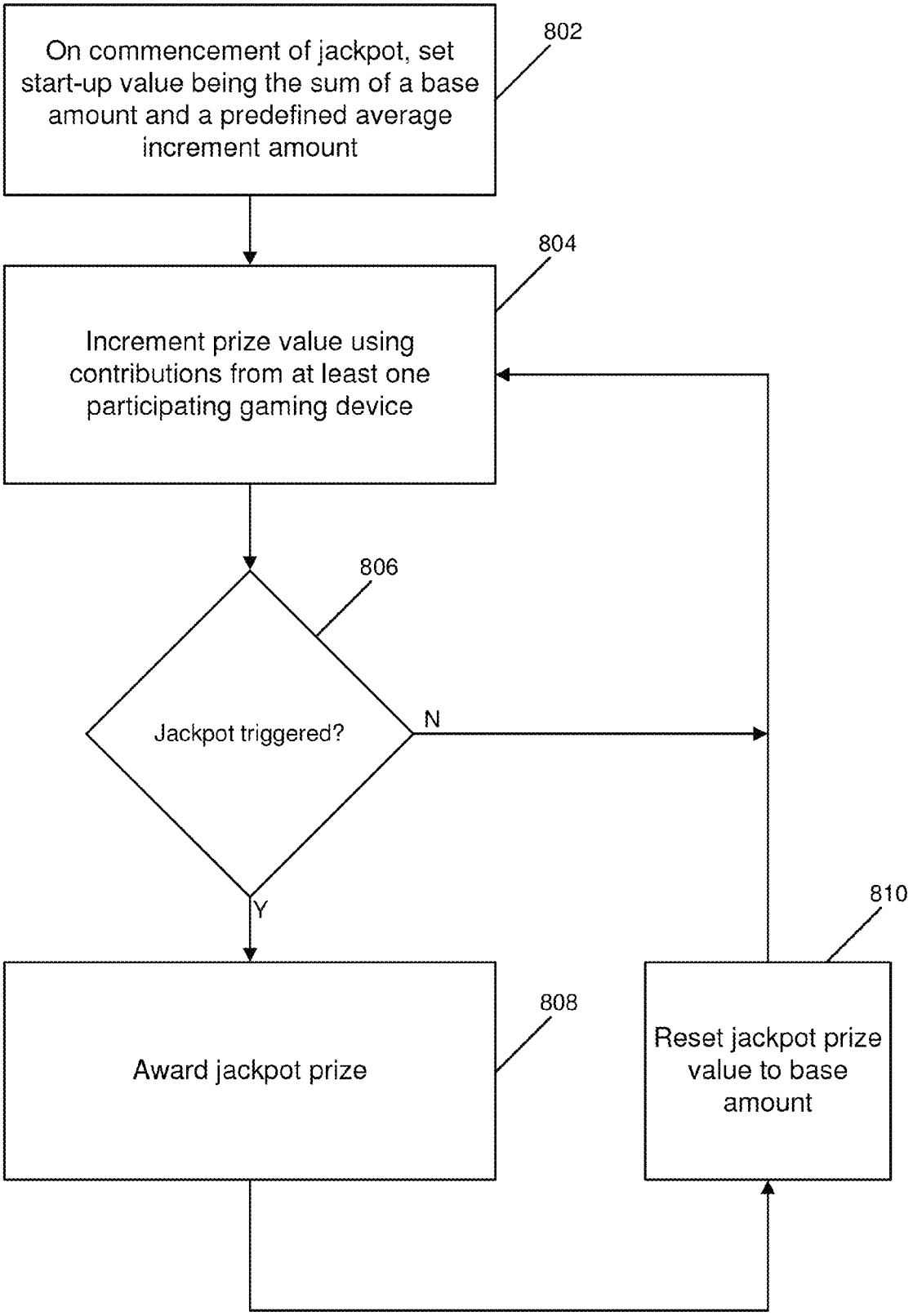
FIG. 9 is a flow chart of an embodiment.

The method 800 of the embodiment is summarised in FIG. 9 and involves, on commencement of the jackpot, setting (802) a start-up jackpot prize value, the start-up prize value being the sum of a base amount and a predefined average increment amount for the jackpot. The jackpot prize value is incremented (804) using contributions from at least one participating gaming device until a jackpot trigger is determined. In response to determining (806) the jackpot trigger, the jackpot prize is awarded (808) and the jackpot prize value reset (810) to the base amount.

In some embodiments the base amount and average increment may be able to be defined by a casino operator on initial set up of the jackpot game when the jackpot game is put into commission. In some embodiments the ratio of average increment to base amount may be fixed, for example to comply with regulated return to player percentages, so that setting of any one of the increment, average increment or base amount causes a corresponding adjustment of the remaining configuration parameters. In alternative embodiments the configuration parameters may be defined independently in accordance with rules, stored in memory 152, to ensure regulatory compliance. Once the base amount, increment and average increment have been defined and the jackpot game commissioned these cannot be changed. The jackpot game will start with a start-up value equal to the sum of the base and average increment and after award of a jackpot will be reset to the base amount. If the jackpot game is taken out of commission and recommissioned at a later date the configuration parameters may be adjusted before recommissioning, in accordance with relevant regulations. For example if the jackpot game is removed for a time to enable a different jackpot game to be offered, then the jackpot configuration parameters may be set differently when the jackpot game is offered again. If the casino operator chooses to change the value of the jackpot offered, then this may also be done by taking the jackpot game out of commission, adjusting the configuration parameters and recommissioning the jackpot game, in accordance with the relevant regulations. On recommissioning the jackpot will have a start-up value that is the sum of the redefined base amount and average increment and be reset to the base amount after being awarded.

Further aspects of the method will be apparent from the above description of the gaming system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

For example, the jackpot controller 150 is shown in FIG. 1 as a separate entity to the gaming devices 10. In an alternative embodiment, it could be provided by one of the gaming devices incorporating a server module arranged to implement the jackpot controller in the manner described in Australian patent application 2008205413 filed 13 Aug. 2008.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method for providing a jackpot on a gaming system including at least one gaming device and a jackpot server in data communication with each at least one gaming device, the jackpot controlled by a jackpot server-implemented jackpot controller including a processor, said method comprising:

for a plurality of plays of a wagering game occurring prior to a commencement of the gaming system:

receiving, by the jackpot controller, data indicating an amount of credit wagered for each play;

applying, by the jackpot controller, a contribution rate to the amount of credit wagered for each play to contribute to a progressive jackpot prize value;

computing, by the jackpot controller, an average accumulated turnover between a plurality of successive awards of a jackpot prize of the jackpot; and computing, by the jackpot controller, an average jackpot return of the jackpot;

based upon the average accumulated turnover and the contribution rate of the amount of credit wagered, determining, by the jackpot controller, an average increment amount for the jackpot, wherein the average increment amount represents an average amount by which the jackpot prize value is incremented before the jackpot prize is awarded;

upon the commencement of the gaming system, setting, by the jackpot controller, a startup jackpot prize value, the start-up jackpot prize value being the sum of a base amount and the average increment amount, such that the start-up jackpot prize value is no less than the average jackpot return;

incrementing the progressive jackpot prize value by the jackpot controller by the contributed amount of credit wagered from at least one participating gaming device until a jackpot trigger is detected; and in response to the jackpot controller detecting the jackpot trigger, awarding the jackpot prize and re-setting the jackpot prize value to at most the base amount.

2. A method as claimed in claim 1, further comprising repeating said incrementing and said detecting for awarding subsequent jackpots.

3. A method as claimed in claim 1, wherein the average increment amount is a fixed percentage of the base amount.

4. A method as claimed in claim 1, wherein the jackpot is a progressive jackpot such that each participating gaming device contributes to the jackpot prize at the contribution rate, which includes a fixed, predefined contribution rate.

5. A method as claimed in claim 1, wherein the base value is a fixed non-zero amount.

6. A method as claimed in claim 1, further comprising the jackpot controller incrementing a hidden meter using a portion of the contributed amount of credit wagered in order to fund the base amount, once the jackpot prize value has been re-set.

7. A jackpot controller for a gaming system including at least one gaming device and a jackpot server in data communication with each at least one gaming device, said jackpot controller configured to maintain a jackpot for the gaming system, said jackpot controller comprising:

a memory; and a processor configured to implement at least a configuration module, an increment processor, and an award handler;

said increment processor configured to, for a plurality of plays of a wagering game occurring prior to a commencement of the gaming system:

receive data indicating an amount of credit wagered for each play;

apply a contribution rate to the amount of credit wagered for each play to contribute to a progressive jackpot prize value;

compute an average accumulated turnover between a plurality of successive awards of a jackpot prize of the jackpot; and compute an average jackpot return of the jackpot;

said increment processor further configured to determine, based upon the average accumulated turnover and the contribution rate of the amount of credit wagered, an average increment amount for the jackpot, wherein the average increment amount represents an average amount by which the jackpot prize value is incremented before the jackpot prize is awarded;

said configuration module configured to set a start-up jackpot prize value upon the commencement of the jackpot, the start-up jackpot prize value being the sum of a base amount and the average increment amount, such that the start-up jackpot prize value is no less than an average jackpot return;

said increment processor further configured to increment the progressive jackpot prize value by the contributed amount of credit wagered from at least one participating gaming device until a jackpot trigger is detected; and said award handler configured to award the jackpot prize in response to said increment processor detecting the trigger, and instruct the jackpot prize value to be reset to at most the base amount.

8. A jackpot controller as claimed in claim 7, wherein the average increment amount is a fixed percentage of the base amount.

9. A jackpot controller as claimed in claim 7, wherein the jackpot is a progressive jackpot such that each participating gaming device contributes to the jackpot prize at the contribution rate, which includes a predefined contribution rate.

10. A jackpot controller as claimed in claim 7, wherein the base value is a fixed non-zero amount.

11. A jackpot controller as claimed in claim 7, wherein the increment processor is further configured to increment a hidden meter using a portion of the contributed amount of credit wagered in order to fund the base amount, once the jackpot prize value has been re-set.

12. A jackpot controller as claimed in claim 7, wherein the trigger is a symbol driven trigger occurring on at least one participating gaming machine.

13. A jackpot controller as claimed in claim 7, wherein the trigger is a randomly determined mystery trigger which falls within a range which spans between the base amount and a predefined maximum trigger value.

14. A jackpot controller as claim in claim 7 further comprising a computer program for maintaining the jackpot.

15. A jackpot controller as claimed in claim 14 further comprising a non-transitory tangible computer readable medium for storing said computer program.

16. A gaming system comprising at least one gaming device and a jackpot server in data communication with each at least one gaming device, the gaming device comprising a credit input mechanism and a game controller, the credit input mechanism configured to receive a credit input from a player of the gaming device, the credit input mechanism comprises at least one of a coin input chute, a bill collector, a card reader, and a ticket reader, and the game controller configured to establish a credit balance associated with the player based on the credit input and determine an amount of credit wagered for a play at the gaming device, the jackpot server comprising a jackpot controller configured to maintain a jackpot, said jackpot controller comprising:

a memory; and a processor configured to implement at least a configuration module, an increment processor, and an award handler;

said increment processor configured to, for a plurality of plays of a wagering game occurring prior to a commencement of the gaming system:

receive data indicating an amount of credit wagered for each play from a respective game controller of each at least one gaming device;

apply a contribution rate to the amount of credit wagered for each play to contribute to a progressive jackpot prize value;

compute an average accumulated turnover between a plurality of successive awards of a jackpot prize of the jackpot; and compute an average jackpot return of the jackpot;

said increment processor further configured to determine, based upon the average accumulated turnover and the contribution rate of the amount of credit wagered, an average increment amount for the jackpot, wherein the average increment amount represents an average amount by which the jackpot prize value is incremented before the jackpot prize is awarded;

said configuration module configured to set a start-up jackpot prize value upon the commencement of the jackpot, the start-up jackpot prize value being the sum of a base amount and the average increment amount, such that the start-up jackpot prize value is no less than an average jackpot return;

said increment processor configured to increment the progressive jackpot prize value by the contributed amount of credit wagered from at least one participating gaming device until a jackpot trigger is detected; and said award handler configured to award the jackpot prize in response to said increment processor detecting the trigger, and instruct the jackpot prize value to be reset to at most the base amount.

* * * * *